US006207227B1

(12) United States Patent
Russo et al.

(10) Patent No.: US 6,207,227 B1
(45) Date of Patent: Mar. 27, 2001

(54) CLEANING ARTICLE AND METHOD

(75) Inventors: Peter B. Russo, Califon, NJ (US); Barry M. Scott, West Bend, WI (US)

(73) Assignee: The Texwipe Company LLC, Upper Saddle River, NJ (US)

( * ) Notice: Subject to any disclaimer, the term of this patent is extended or adjusted under 35 U.S.C. 154(b) by 0 days.

(21) Appl. No.: 09/156,943

(22) Filed: Sep. 18, 1998

(51) Int. Cl.[7] ..... B05D 5/10; B05D 1/38; B05D 3/02

(52) U.S. Cl. ..... 427/208.6; 427/208.8; 427/210; 427/261; 427/286; 427/289; 427/381; 427/382; 427/389.9; 427/391; 427/394; 427/395; 427/411

(58) Field of Search ..... 101/181, 183; 427/209, 210, 211, 207.1, 208, 208.6, 208.8, 261, 286, 288, 289, 381, 382, 389.9, 391, 394, 395, 412, 411, 428

(56) References Cited

U.S. PATENT DOCUMENTS

| | | | | |
|---|---|---|---|---|
| 2,796,367 | | 6/1957 | Brown . | |
| 3,754,991 | | 8/1973 | Amos et al. . | |
| 4,357,615 | | 11/1982 | Yoshiharu et al. . | |
| 4,402,599 | | 9/1983 | Seto . | |
| 4,437,402 | * | 3/1984 | Fischer | 101/181 |
| 4,611,361 | | 9/1986 | Shinkai . | |
| 4,686,132 | | 8/1987 | Sumii et al. . | |
| 4,841,903 | | 6/1989 | Bird . | |
| 4,891,265 | | 1/1990 | Samagalsky . | |
| 4,933,015 | | 6/1990 | White . | |
| 5,004,630 | | 4/1991 | Polski . | |
| 5,019,421 | | 5/1991 | Mecke et al. . | |
| 5,026,587 | | 6/1991 | Austin et al. . | |
| 5,053,157 | | 10/1991 | Lloyd . | |
| 5,138,004 | * | 8/1992 | DePierne et al. | 526/293 |
| 5,138,390 | | 8/1992 | Miyabayashi et al. . | |
| 5,153,964 | | 10/1992 | Gelardi et al. . | |
| 5,198,292 | | 3/1993 | Lerner et al. . | |
| 5,198,293 | * | 3/1993 | Metrick | 428/290 |
| 5,227,844 | * | 7/1993 | Bhattacharjee et al. | 355/215 |
| 5,686,169 | * | 11/1997 | Hassall et al. | 428/195 |
| 5,868,844 | * | 2/1999 | Kato et al. | 118/62 |
| 6,030,674 | * | 2/2000 | Onishi et al. | 428/40.1 |

* cited by examiner

*Primary Examiner*—Shrive Beck
*Assistant Examiner*—Michael Barr
(74) *Attorney, Agent, or Firm*—Kramer Levin Naftalis & Frankel LLP; Gregor N. Neff

(57) ABSTRACT

A cleaning sheet with a tacky surface coating is used to clean feed rollers in copying machines or similar equipment and similarly-coated cloths are used for the removal of particles from other surfaces to be cleaned. The cleaning articles are made by printing the tacky material on sheet material such as paper or cloth. Relatively thick layers of tacky material are applied quickly and economically by the use of a multi-stage printing press which builds up a thick layer from a plurality of thin layers.

13 Claims, 2 Drawing Sheets

CLEANING ARTICLE AND METHOD

This invention relates to cleaning articles, and to methods of making and using them. More particularly, this invention relates to cleaning articles in sheet form having a coating of tacky material on the surface, and to methods of making and using them.

Sheets with coatings of tacky material have been used for cleaning the rollers and other parts of office equipment, such as copying machines, printers, etc. For example, a piece of card stock or paper with the tacky material on its surface is passed through the rolls of a copying machine and any loose toner particles or other particles of dirt adhere to the tacky material and are lifted off of the rollers. This cleaning is done without the use of any solvents or disassembly or service calls for the machine in question. It is time-saving and is quick and efficient to use.

Special problems arise in the provision of path cleaning sheets for use in cleaning the rolls of certain heavy-usage industrial type reproduction equipment, such as microfilm machines used by express delivery companies and others to microfilm carbonless forms and the like, in which relatively large amounts of dirt and particles must be removed. For such heavy-duty use, a relatively much thicker layer of tacky material is needed.

In the past, such thick coatings of pressure-sensitive adhesive material have been applied by silk screening. However, this process is relatively slow and tends to leave relatively large globules of adhesive on the surface of the sheet to which it is applied. In addition, it tends to use substantial quantities of adhesive.

A similar problem exists with tacky cloths which are used for removing relatively large particles, such as abrasive particles, dust, lint, etc. from surfaces. In particular, such tacky cloths often are used to remove sanding grit, etc., in preparing automobile surfaces for painting in the manufacture and repainting of automobiles.

Typically, cloth material is soaked in adhesive or has adhesive sprayed or printed onto it to permeate the fibers of the cloth with a tacky material. Such methods use excessive amounts of adhesive, and the adhesive escapes onto the hands of those using the cloths, and also is rubbed off onto the surface being cleaned.

Another problem with the manufacture of paper path cleaning sheets is that processes used to make them are relatively slow and costly.

It has been proposed in the past to apply tacky materials to paper or card stock backing sheets by calendaring, painting, spraying, rolling on by pressure rollers, or forming adhesive material into a sheet and gluing it onto the backing sheet. None of these prior methods is satisfactory in solving the problems described above.

Accordingly, it is an object of the present invention to provide a cleaning article and method of manufacture and use which solves or alleviates the foregoing problems.

It is another object of the present invention to provide a process for manufacturing cleaning articles such as path cleaning sheets and tacky cloths which is faster, uses less adhesive, and produces a smooth coating which is of the appropriate thickness, without globules.

It also is an object of the invention to provide a method of using a cleaning article of the present invention in cleaning rollers in copying equipment and other such equipment.

The foregoing objects are met, in accordance with the present invention, by the provision of a process for coating paper or cloth with tacky material such as a pressure-sensitive adhesive by the use of a web upon which adhesive coatings are applied by means of a printing press.

In particular, the printing press preferably is a multi-stage color printing press in which color separations are printed at successive stations along a web, in the normal use of the printing press. In accordance with the present invention, adhesive is applied to the plates of the printing press which then lay down successive layers of adhesive, one on top of the other, to build up a relatively thick layer of adhesive which is smooth and substantially globule-free.

Preferably, heated air is used to dry the adhesive coats somewhat between stations of the printing press so as to at least partially dry one adhesive coating before the next coat is applied.

The inherently high degree of accuracy achieved by such presses in registering one printed image with respect to the others is used to accurately overlay several coats of adhesive to form thick, even, and globule-free adhesive coatings.

The foregoing and other objects and advantages of the invention are set forth in or will be apparent from the following descriptions and drawings.

IN THE DRAWINGS

GENERAL DESCRIPTION

Figure 1:
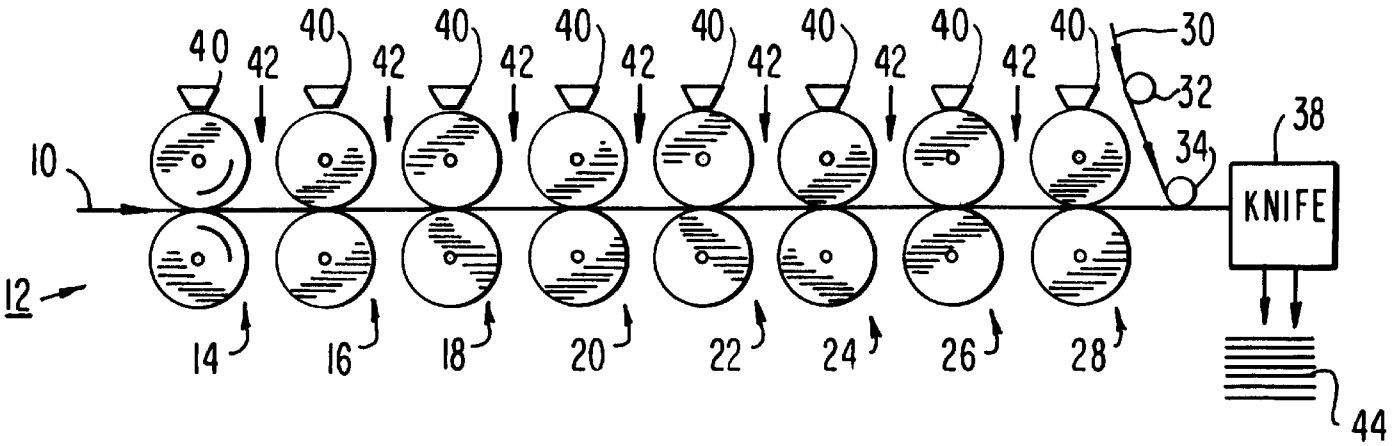
FIG. 1 is a schematic side-elevation view of a printing press used to manufacture cleaning articles of paper and cloth bearing a multi-layer coating of a tacky material.

FIG. 1 shows schematically a multi-stage flexographic printing press 12 which is used, in accordance with the present invention, in applying successive coats of adhesive to a backing material 10 in patterns which are repeated from one station to the next so that multiple layers of adhesive are applied in the same area.

The backing material 10 is supplied in the form of a web. It is passed successively through eight different stages 14, 16, 18, 20, 22, 24, 26 and 28 of the press. At each of the stations, a printing plate (not shown) is provided which is attached to the surface of the upper one of the two rollers at the station. Normally, ink is supplied from an ink supply shown schematically at 40 to the raised pattern on the printing plate every time the drum to which the plate is attached rotates.

In accordance with the present invention, a sealing coat is applied to the web instead of ink at the first station 14, and an adhesive coat is applied at each of the other stations, 16, 18, 20, 22, 24, 26 and 28.

The spacing between stations is constant. The print pattern formed by the press at each station is in registry with the pattern formed at the previous station with a high degree of accuracy. This is so because the press normally is used for color printing using color separations, and such accuracy is needed for good color printing.

The press 12 preferably is a narrow press being able to receive a web as wide as nine inches in width, and normally is used for printing labels, brochures, etc., in color.

Preferably, between each stage of the printing press, hot air is blown onto the web as indicated by each of the arrows 42 in FIG. 1. The air is heated, preferably, to a temperature of from 100° F. to 400° F., and the time of drying typically varies between 1 and 5 seconds. The speed of the web and the temperature of the hot air blown onto the web between stations is set so that the coating dries enough to prevent the next coat from being dissolved into the prior coat. This insures the provision of a smooth multi-layer coating.

At the output end of the press, there is provided a continuous sheet of release paper 30 which passes over rolls 32 and 34 and is applied to the tacky coatings at separate locations on the upper surface of the web so as to protect it from accumulating dirt, and from unwanted adherence to objects it comes in contact with.

Then, the combined web enters a cutting mechanism 38 which cuts the sheets in between the areas covered with tacky material to form a stack of sheets 44.

Path Cleaning Sheet

A typical sheet formed by the process described above is shown at 50 in FIG. 2. The sheet 50 is paper or card stock with marginal areas 54 and 56 at the beginning and the end of the sheet, and a printed coating of adhesive 52 in between.

The pattern which is printed on the web can be essentially any pattern desired to adapt it to the task for which the cleaning sheet is required.

Figure 3:
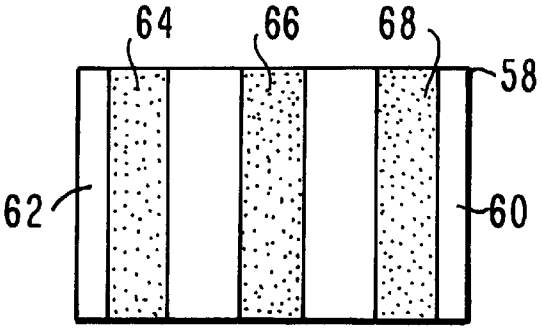
FIG. 3 is a top plan view of another embodiment of cleaning article constructed in accordance with the present invention.

FIG. 3 shows another tacky path cleaning sheet 58 which has forward and rear margins 60 and 62, and three separate longitudinally separated strips 64, 66 and 68 of tacky material. This particular pattern is desired for cleaning certain copying machines and other equipment, as is more fully described in U.S. Pat. No. 5,227,844, which is assigned to the same Assignee as the present patent application. The disclosure of that patent hereby is incorporated herein by reference.

It should be understood that the printing process, and particularly one using a web as shown in FIG. 1, is advantageous for use in producing paper path cleaning sheets or other cleaning articles which require only relatively thin coatings as well as thick coatings.

As noted above, the first stage 14 of the printing press shown in FIG. 1 applies a sealer coating to each area to be printed. This inhibits the adhesive applied onto the paper at the other stations from soaking into the paper too deeply. This keeps the coating smooth and minimizes the amount of adhesive used. It tends to keep the adhesive from reaching the opposite side of a wiper and covering the hands of one using the wiper. Also, it avoids unwanted deposit of adhesive on the object being cleaned.

Figure 2:
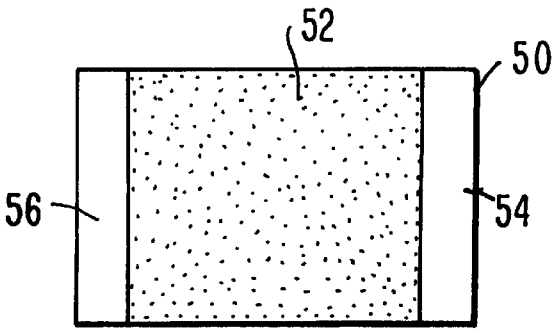
FIG. 2 is a top plan view of one embodiment of the cleaning article manufactured in accordance with the present invention.
Figure 4:
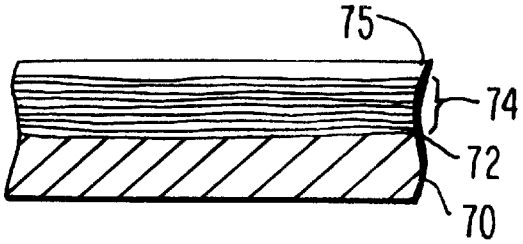

FIG. 4 is a cross-sectional view of a cleaning article such as that shown in FIG. 2 made on the printing press 12 of FIG. 1. The article includes a paper sheet 70 which has a textured surface to promote best functioning of the adhesive layer in picking up particles, a layer of sealer material 72, and seven layers 74 of adhesive, and a release sheet 75. The thickness of the adhesive layer considered best for use in the very dirty path-cleaning uses described above is from 1 to 2 mils.

As an example, the paper 70 is a 65 pound bond, patterned "felt-weave" cover stock.

Figure 5:
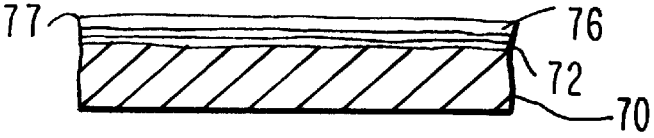
FIGS. 4 and 5 are enlarged cross-sectional views of cleaning articles constructed in accordance with the present invention.

FIG. 5 shows a paper path cleaner used in cleaning less severely dirty surfaces. The sheet has a paper base 70, a sealing layer 72 and a single layer 76 of adhesive covered by a release sheet 77. Typically, the adhesive layer thickness is only ¼ to ½ of a mil, as compared with the much greater thickness of the article shown in FIG. 4. The number of layers can be varied as needed.

The release paper preferably is a silicone-coated kraft paper.

Tacky Cloths

Figure 7:
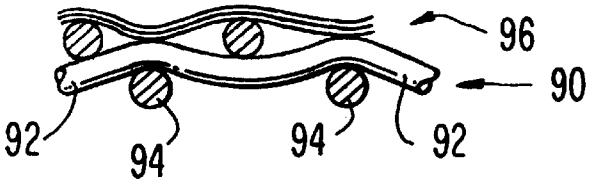
FIGS. 6 and 7 are cross-sectional view of cleaning cloths made in accordance with the present invention.
Figure 6:
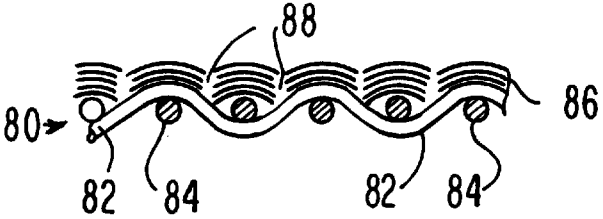

FIGS. 6 and 7 show cross-sections of typical woven cloths with coatings of tacky material in accordance with the present invention.

The cloth 80 shown in FIG. 6 is relatively thin and has a sealer coat covered by multiple layers 86 of adhesive which have been applied by the printing process illustrated in FIG. 1. The cloth 80 forms a web and the printing proceeds just as it does for the manufacture of paper path cleaners described above. However, the warp and weft threads 82 and 84 of the cloth do not form nearly as smooth a surface as does the paper or cardstock 70. Therefore, the layers of adhesive may have gaps such as those shown at 88 in between sections of the coatings.

The cloth 90 shown in FIG. 7 is thicker with larger diameter threads 91, 94, with a coating 96 including a sealer and multiple layers of adhesive atop the sealer coat. Due to the greater spacing between adjacent fibers, the printed adhesive tends to adhere to the fibers in a more or less continuous coating. However, gaps in the coating also can occur, as in the cloth shown in FIG. 6.

Again, the printing process illustrated in FIG. 1 produces a smooth, globule-free coating on the cloth. Moreover, the quantity of adhesive used is believed to be significantly less than with other methods, resulting in less wastage and lower costs, and better performance of the wiping cloth since there is little or no excess tacky material to come off on the hands of the users or on the surfaces being cleaned.

Path Cleaning

Figure 8:
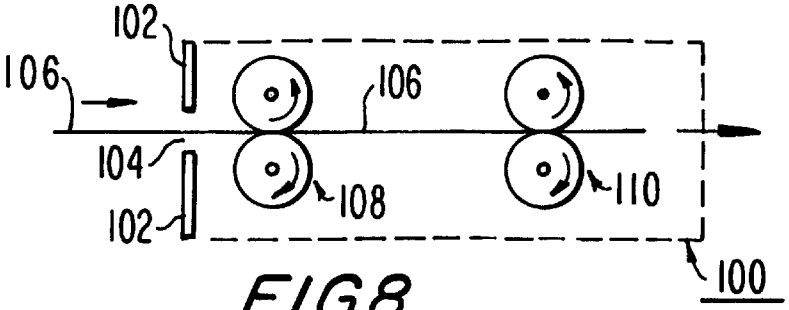
FIG. 8 is a schematic view showing the use of one of the cleaning articles in cleaning the rollers in a copying machine.

FIG. 8 is a schematic cross-sectional view of a copying machine having sets of rollers 108 and 110 and an inlet opening 104 leading into the rollers 108 and 110. Typically, the rollers 108 and 110 are used to convey a document being microfilmed, such as a "carbonless" bill of lading, which sheds many particles which accumulate on the rollers 108 and 110.

A paper path cleaning sheet 106 is inserted between the rollers 108 and 110 and usually is passed through the rollers several times in order to cleanse them of accumulated dirt. The thick coating of adhesive picks up the large quantities of particles readily.

The machine 100 also is representative of an ordinary xerographic type of copying machine in which toner particles cause the problem instead of carbon particles from forms. Although this type of machine usually does not require the thick coating on the article shown in FIG. 4, the path cleaner can be manufactured advantageously, in accordance with the present invention, by simply using fewer stages of the press.

Materials

Preferably, the sealer is an acrylic resin water-based material which closes the pores of the paper to minimize the amount of adhesive soaked into the paper or fabric of the web.

The adhesive preferably is an acrylic polymer emulsion which is commonly used as a pressure-sensitive adhesive. The material is made and sold for the purpose by B.F. Goodrich.

The printing plates are conventional plates made of a photopolymer. The raised printing areas on the plates can be given almost any shape to form a desired pattern, in accordance with standard printing plate manufacturing techniques.

The base materials can be paper, hydro-entangled wipers such as those made of a blend of polyester and cellulose fibers sold under the trademark "Technicloth" by The Texwipe Company, or woven or knitted cloth made of natural or synthetic fibers. Preferably, the material is dry before printing is started.

Alternative Method and Structures

It should be understood that other printing processes and machines can be used in the present invention. However, a web-fed press is considered to have substantial advantages in that it is very fast, is well adapted to low-cost, relatively high-speed operation in applying multiple coats of adhesive, and is economical to operate.

The above description of the invention is intended to be illustrative and not limiting. Various changes or modifications in the embodiments described may occur to those skilled in the art. These can be made without departing from the spirit or scope of the invention.

What is claimed is:

1. A process for making cleaning articles with a tacky surface, said process comprising the steps of:

(a) providing a web of a base sheet material for said cleaning articles;

(b) moving said web past a plurality of application stations; and (c) adhering a layer of tacky adhesive to the surface of said web by printing said adhesive onto said web in a predetermined pattern at each of said application stations, each of said coatings after the first coating overlying the previous coating.

2. A process as in claim 1 in which said printing step comprises repetitively printing said pattern at spaced intervals on said web, and severing said web at locations in the spaces between said patterns to form separate cleaning articles.

3. A process as in claim 1 including the step of using a multi-stage color separation printing press to do said printing, each of said application stations corresponding to one of said stages of said printing press.

4. A process as in claim 1 including the step of at least partially drying each coating before applying the next one.

5. A process as in claim 1 including applying a sealer to said web to underlie said adhesive.

6. A process as in claim 3 in which said printing press is a flexographic press with multiple stations for printing color separations and including the step of preparing a printing plate for each of said stages of said press, said plate having a relief printing area in the shape of the area of said web on to which said tacky adhesive coating is to be printed.

7. A process as in claim 6 in which said web is made of a material selected from the group consisting of paper; hydro entangled polyester and cellulose fibers; woven cloth; and knitted cloth.

8. A process for making cleaning articles with a tacky surface, said process comprising the steps of:

(a) providing a web of a base sheet material for said cleaning articles;

(b) moving said web past a plurality of application stations;

(c) adhering a layer of tacky adhesive to the surface of said web by printing said adhesive onto said web in a predetermined pattern at each of said application stations, each of said coatings after the first coating overlying the previous coating; and (d) at least partially drying each coating before applying the next one by directing against said web a stream of air heated to a temperature of from approximately 100° F. to 400° F. for approximately 1 second to 5 seconds.

9. A process for making cleaning articles having a tacky surface, said process comprising the steps of:

(a) providing a support sheet, and (b) printing successive superimposed layers of a tacky adhesive onto said support sheet in a predetermined pattern by use of a printing press.

10. A process as in claim 9 in which said printing press is a multi-stage color separation printing press with a printing plate at each of said stations and which has means for supplying adhesive to each of said plates, and in which said support sheet is a web.

11. A process as in claim 10 in which said press is a flexographic press, and including the steps of applying a release sheet cover to each area of adhesive printed on said web, and cutting said web to form separate cleaning articles.

12. A process as in claim 9 in which said support sheet is made of a material selected from the group consisting of paper; hydro-entangled polyester and cellulose fibers; woven cloth; and knitted cloth.

13. A process as in claim 10 in which said means for feeding adhesive is the means provided in said press for feeding ink during use of said press for printing, and said adhesive is a water-based latex pressure-sensitive adhesive.

* * * * *